US008021283B2

(12) United States Patent
Sato et al.

(10) Patent No.: US 8,021,283 B2
(45) Date of Patent: Sep. 20, 2011

(54) PRESSURE MUSCLE STRENGTH INCREASING APPARATUS, CONTROL DEVICE, AND METHOD BEING CARRIED OUT BY CONTROL DEVICE

(75) Inventors: Yoshiaki Sato, Tokyo (JP); Yoshihisa Yamazaki, Tokyo (JP)

(73) Assignee: Sato Sports Plaza Co., Ltd., Tokyo (JP)

( * ) Notice: Subject to any disclaimer, the term of this patent is extended or adjusted under 35 U.S.C. 154(b) by 113 days.

(21) Appl. No.: 10/561,166

(22) PCT Filed: Jun. 18, 2004

(86) PCT No.: PCT/JP2004/008955

§ 371 (c)(1),
(2), (4) Date: Dec. 16, 2005

(87) PCT Pub. No.: WO2004/112913

PCT Pub. Date: Dec. 29, 2004

(65) Prior Publication Data

US 2006/0128538 A1 Jun. 15, 2006

(30) Foreign Application Priority Data

Jun. 19, 2003 (JP) ..... 2003-174813

(51) Int. Cl.
*A63B 21/008* (2006.01)
*A61H 7/00* (2006.01)

(52) U.S. Cl. ..... 482/111; 601/150

(58) Field of Classification Search ..... 482/111–113, 482/4–9; 601/148–152

See application file for complete search history.

(56) References Cited

U.S. PATENT DOCUMENTS 1,288,130 A 12/1918 Nagelman (Continued)

FOREIGN PATENT DOCUMENTS

EP 0 030 705 A1 6/1981

(Continued)

OTHER PUBLICATIONS

Supplementary European Search Report dated Jan. 20, 2009.

(Continued)

*Primary Examiner* — Fenn Mathew

(74) *Attorney, Agent, or Firm* — Edell, Shapiro & Finnan, LLC

(57) ABSTRACT

To provide a pressure muscle strength increasing apparatus that allows accurate adjustment of the degree of blood flow restriction when a pressure muscle strength increasing method is carried out.

The pressure muscle strength increasing apparatus is comprised of a tight fitting device 100, a pressure setting segment 200, quantification segments 300, and a control segment 400. The tight fitting device 100 is wrapped around a predetermined range on a limb. The tight fitting device 100 has an air-tight gas bag. The compression force applied to the limb can be varied by supplying the air to and removing the air from the gas bag. The pressure setting segment 200 controls the supply and removal of the air into and from the gas bag. The quantification segment 300 is intended to be rest on the limb which the tight fitting device 100 is wrapped around on the distal side thereof to quantify a quantification target that varies depending on the increase and decrease of the compression force. The control segment 400 controls the pressure setting segment 200 based on the quantification target. As described above, the pressure muscle strength increasing apparatus automatically controls the compression force based on the quantification target.

16 Claims, 7 Drawing Sheets

U.S. PATENT DOCUMENTS

| | | | | | |
|---|---|---|---|---|---|
| 1,658,381 | A | | 2/1928 | Kilstrom | |
| 2,332,488 | A | | 10/1943 | Newton | |
| 4,469,099 | A | | 9/1984 | McEwen | |
| 4,770,175 | A | | 9/1988 | McEwen | |
| 4,831,242 | A | | 5/1989 | Englehardt et al. | |
| 4,984,579 | A | | 1/1991 | Burgert et al. | |
| 4,991,573 | A | | 2/1991 | Miller | |
| 5,211,162 | A | * | 5/1993 | Gillen et al. | 601/149 |
| 5,219,356 | A | | 6/1993 | Harreld et al. | |
| 5,316,022 | A | | 5/1994 | Schiek, Sr. | |
| 5,413,582 | A | | 5/1995 | Eaton | |
| 5,433,724 | A | | 7/1995 | Kawasaki et al. | |
| 5,458,571 | A | | 10/1995 | Lampropoulos et al. | |
| 5,464,136 | A | | 11/1995 | Eddy | |
| 5,634,889 | A | * | 6/1997 | Gardner et al. | 601/151 |
| 5,738,612 | A | * | 4/1998 | Tsuda | 482/8 |
| 5,755,669 | A | | 5/1998 | Ono et al. | |
| 5,791,348 | A | | 8/1998 | Aung et al. | |
| 6,080,120 | A | * | 6/2000 | Sandman et al. | 601/152 |
| 6,149,618 | A | | 11/2000 | Sato | |
| 6,149,674 | A | * | 11/2000 | Borders | 607/96 |
| 6,237,602 | B1 | | 5/2001 | Nickels et al. | |
| 6,427,697 | B1 | | 8/2002 | Pearcey | |
| 6,558,338 | B1 | * | 5/2003 | Wasserman | 601/152 |
| 6,616,579 | B1 | * | 9/2003 | Reinbold et al. | 482/91 |
| 6,736,786 | B1 | * | 5/2004 | Shatby et al. | 601/152 |
| 6,746,470 | B2 | | 6/2004 | McEwen et al. | |
| 6,953,440 | B2 | * | 10/2005 | Porrata et al. | 601/149 |
| 7,070,572 | B2 | | 7/2006 | Reinecke et al. | |
| 2006/0270530 | A1 | | 11/2006 | Sato | |

FOREIGN PATENT DOCUMENTS

| | | | | |
|---|---|---|---|---|
| EP | 0 247 715 | A1 | | 12/1987 |
| EP | 0 298 620 | A1 | | 1/1989 |
| EP | 1 025 880 | A1 | | 8/2000 |
| EP | 1 249 218 | A2 | | 10/2002 |
| FR | 2 673 368 | A1 | | 9/1992 |
| JP | S59-137704 | | | 9/1984 |
| JP | S62-170228 | | | 7/1987 |
| JP | S63-43501 | | | 3/1988 |
| JP | S63-200409 | | | 12/1988 |
| JP | H5-68503 | | | 9/1993 |
| JP | 06-277311 | | | 10/1994 |
| JP | 07-144027 | | | 6/1995 |
| JP | 09-278259 | | | 10/1997 |
| JP | 10-085361 | | | 4/1998 |
| JP | 10-085362 | | | 4/1998 |
| JP | 10-137204 | | | 5/1998 |
| JP | 10137204 | A | * | 5/1998 |
| JP | 10-147204 | | | 6/1998 |
| JP | 11-299749 | | | 11/1999 |
| JP | 2001-340461 | | | 12/2001 |
| JP | 2002-102182 | | | 4/2002 |
| JP | 2004-215858 | | | 8/2004 |
| JP | 2004-313423 | A | | 11/2004 |
| JP | 2005-509 | A | | 1/2005 |
| JP | 2005-6921 | A | | 1/2005 |
| KR | 2003-0025725 | | | 3/2003 |
| WO | WO 00/10649 | | | 3/2000 |

OTHER PUBLICATIONS

Russian Office Action dated Sep. 25, 2007.

Russian Office Action dated Jul. 3, 2007 and English translation.

American Diabetes Association, "Exercise and Blood Glucose", Sep. 23, 2004, http://web.archive.org/web/20040923135336/http://www.diabetes.org/youthzone/physical-activity-bg-jsp.

Craig C. Freudenrich, "How Exercise Works", Feb. 17, 2004, http://web.archive.org/web/20040217145709/health.howstuffworks.com/sports-physiology2.htm.

Supplementary European Search Report—search completed Jun. 20, 2008.

Article entitled "Blood Pressure Monitoring: How to measure blood pressure", 2003, 3 pages (http://www.medphys.ucl.ac.uk/teaching/undergrad/projects/2003/group_03/how.html).

* cited by examiner

PRESSURE MUSCLE STRENGTH INCREASING APPARATUS, CONTROL DEVICE, AND METHOD BEING CARRIED OUT BY CONTROL DEVICE

TECHNICAL FIELD

The present invention relates to a muscle strength development apparatus for the muscle development. More particularly, the present invention relates to a muscle strength development apparatus suitable for a pressure muscle strength increasing method that allows healthy people as well as people having motor abnormalities to increase their muscle strength in an effective manner.

BACKGROUND ART

One of the present inventors has conducted studies for some time in order to work out a muscle strength increasing method for easy, safe, and effective muscle development, and put together the accomplishments into a patent application having Japanese Patent Application No. 5-313949, which has been granted as Japanese Patent No. 2670421.

The muscle strength increasing method according to the subject patent, which involves the application of pressure, is a distinctive non-conventional one called a "Pressure Muscle Strength Increasing Method". This muscle strength increasing method is based on the following theoretical concept.

Muscles are composed of slow-twitch muscle fibers and fast-twitch muscle fibers. Slow-twitch muscle fibers are limited in their potential for growth. Accordingly, it is necessary to recruit fast-twitch muscle fibers of the slow- and fast-twitch muscle fibers in order to develop muscles. Recruitment of fast-twitch muscle fibers causes lactic acid buildup in the muscles, which triggers secretion of growth hormone from the pituitary. The growth hormone has effects of, for example, promoting muscle growth and shedding body fat. This means that recruitment and exhaustion of fast-twitch muscle fibers results in development of fast-twitch muscle fibers and, in turn, the entire muscles.

Slow-twitch muscle fibers and fast-twitch muscle fibers are different from each other in terms of the following. Slow-twitch muscle fibers use oxygen for energy and are recruited for low-intensity activities. Fast-twitch muscle fibers provide for activities regardless of whether or not oxygen is present. They are recruited after the slow-twitch muscle fibers for highly intense activities. Therefore, it is necessary to cause the earlier recruited and activated slow-twitch muscle fibers to be exhausted soon in order to recruit fast-twitch muscle fibers.

Conventional muscle strength increasing methods use heavy exercises with, for example, a barbell to cause the slow-twitch muscle fibers to be exhausted first, and then to recruit the fast-twitch muscle fibers. This recruitment of fast-twitch muscle fibers requires a significant amount of exercises, is time-consuming, and tends to increase the burden on muscles and joints.

On the other hand, when a predetermined range of muscles near the top of a limb is compressed and pressurized to restrict the blood flow therethrough before muscle exercises, less oxygen is supplied to these muscles. The slow-twitch muscle fibers, which require oxygen for energy, are thus exhausted in a short period of time. Muscle exercises with blood-flow restriction by application of pressure will result in recruitment of the fast-twitch muscle fibers without needing a large amount of exercises.

In addition, restriction of the blood flow by application of pressure makes the lactic acid built up in the muscles less likely to be removed from the muscles. Thus, the muscle lactic acid level is more likely to rise and a much larger amount of growth hormone is secreted, as compared with the case where the blood flow is unrestricted.

Based on this theoretical concept, to restrict the muscle blood flow can provide significant development of the muscles.

The muscle strength increasing method according to the aforementioned patent is premised on the theoretical concept of the muscle strength increase by the restriction of blood flow. More specifically, a compression pressure for the blood flow restriction is applied to a range near the muscles that you want to develop and closer to the heart, i.e., a proximal region near those muscles. The compression pressure is controlled to put an appropriate stress attributed to the reduced blood flow on the muscles, thereby causing muscle fatigue. In this way, effective muscle development is achieved.

This muscle force increasing method has a significant feature in muscle development not necessarily requiring exercises because it involves developing muscles by putting a stress attributed to a reduced blood flow on the muscles. In addition, this muscle strength increasing method can compensate for a total amount of stress that is placed on the muscles by putting a stress attributed to a reduced blood flow on the muscles. When combined with some exercises, the method advantageously provides a less exercise-related stress than conventionally. This advantage brings about some effects: the possibility of incurring damages to the joints or muscles can be reduced and the period of training can be shortened, as a result of decrease in amount of muscle exercises.

The implementation of this muscle strength increasing method requires a muscle strength increasing device or apparatus that can restrict the blood flow through the muscles that you want to develop and can provide accurate control of the degree of blood flow restriction. In particular, the function that can provide accurate control of the degree of blood flow restriction in muscles is very important in order to enhance effects obtained using the pressure muscle strength increasing method and to improve the safety of the pressure muscle strength increasing method.

One of the present inventors has made studies for a muscle strength increasing device. In the course of these studies, he made an invention relating to a muscle strength increasing device as disclosed in Japanese Patent Application No. 8-248317. The muscle strength increasing device according to this invention comprises a tight fitting device, which is a bag-shaped belt, having a rubber-made tube provided therein. It is designed to compress muscles and thereby to apply a desired compression pressure to the muscles when a gas is introduced into a tube with the tight fitting device rest on and fastened around a predetermined range of muscles.

Such a muscle strength increasing device of the type that achieves compression using a gas has the advantage of allowing detailed control for the compression pressures by means of measuring a gas pressure. However, it still has a point that should be improved.

Such a muscle strength increasing device is said to be able to measure the compression force applied by the muscle strength increasing device to muscles by measuring the gas pressure within the aforementioned tube. The compression force applied to muscles, which is determined according to the measurement of the gas pressure, provides information that is used to predict the degree of blood flow restriction in muscles. In the aforementioned muscle strength increasing device, an appropriate degree of blood flow restriction is tried to be achieved by changing the gas pressure within the tube based on this prediction.

However, people have individual differences as well as other variations over time, such as gains and losses in body weight. This suggests that a constant compression force does not always result in the same degree of blood flow restriction, so that the above prediction is attended with difficulty.

Thus, the use of such a muscle strength increasing device requires an experienced person with a good knowledge about a pressure muscle strength increasing method who can teach how to use the muscle strength increasing device. In fact, the pressure muscle strength increasing method is carried out under the supervision of a person who is available for the coaching.

In addition, the pressure muscle strength increasing method has a potential use in preventing the decline of muscle strength and the decrease in bone density of an astronaut after having many months of zero gravity in a spaceship, which is a major concern in recent years. However, the distribution of blood through the body in a weightless state differs from that on earth. Accordingly, it is very difficult to predictively determine whether the resulting degree of blood flow restriction becomes appropriate even when a compression force is selected according to the experiences and knowledge about the pressure muscle strength increasing method accumulated on earth.

The present invention is for solving the aforementioned problem and an object thereof is to provide an art with which a muscle strength increasing apparatus can be achieved that is capable of providing accurate control of the degree of blood flow restriction.

SUMMARY OF THE INVENTION

In order to solve the aforementioned problem, the present inventors suggest the following invention.

The present invention is a pressure muscle strength increasing apparatus comprising: a tight fitting device which is intended to encircle a predetermined range of muscles of one of the limbs, is intended to apply a predetermined compression force to said predetermined range of muscles by means of compressing said predetermined range of muscles, and is designed so that said compression force can be varied (by means of, for example, changing the length of the inner circumference of a portion enclosing any one of the limbs); pressure setting means for use in controlling the compression force provided by said tight fitting device; control means for controlling said pressure setting means in order to change said compression force; and quantification means for quantifying, at a position closer to the distal end of a limb than said predetermined range of muscles, a quantification target that is associated with the state of blood flow that varies depending on said compression force.

Said control means in this pressure muscle strength increasing apparatus is adapted to control said pressure setting means based on said quantification target.

In the pressure muscle strength increasing apparatus of the present invention, the pressure setting means controls the compression force for compressing the predetermined range of muscles by the tight fitting device. The pressure setting means is, in turn, controlled by the control means based on the quantification target. This indicates that the aforementioned compression force is controlled through the pressure setting means and the control means, based on the quantification target.

In this case, the quantification target is associated with the state of blood flow that varies depending on said compression force, which is quantified at a position closer to the distal end of the limb where the pressure muscle strength increasing method is carried out than the range on which the tight fitting device is rest, so that the pressure muscle strength increasing apparatus of the present invention can directly change the compression force depending on the degree of actual blood flow restriction. Therefore, this pressure muscle strength increasing apparatus can adjust the degree of blood flow restriction accurately even when the pressure muscle strength increasing method is used in a weightless state, unlike conventional muscle strength increasing devices that involve a huge amount of knowledge and experiences.

It should be noted that the aforementioned control means automatically controls the pressure setting means. A person who uses this pressure muscle strength increasing apparatus to carry out the pressure muscle strength increasing method gets relief from troubles which otherwise occur in adjusting the compression force. The automatic control of the pressure setting means further provides other advantages. The pressure muscle strength increasing method is highly expected to find applications in the field of rehabilitation because muscle strength is expected to increase only by applying a pressure to muscles even for those who cannot do exercise due to, for example, being confined to bed. However, simple adjustment of the compression force is frequently expected to be a burden for them. This may prohibit the progress of the pressure muscle strength increasing method in the rehabilitation usage. However, the one that allows automatic control of the pressure setting means as in the present invention does not cause such a burden. This makes the pressure muscle strength increasing method be applied easier to rehabilitation.

The tight fitting device may have any configuration. It may include, for example, a belt having the length that is enough to be wrapped around a predetermined range of muscles of one of the limbs; fastening means for fastening said belt with said belt being wrapped around said predetermined range of muscles; and a gas bag provided in or on said belt, said gas bag being adapted to apply a predetermined compression force to said predetermined range of muscles by means of compressing said predetermined range of muscles when said gas bag is filled with gas while said belt that has been wrapped around said predetermined range of muscles is fastened by said fastening means.

Effects that are similar to those obtained in the aforementioned case can be obtained in a pressure muscle strength increasing apparatus comprising the tight fitting device of the type described; pressure setting means that is capable of forcing a gas into said gas bag and removing the gas from said gas bag; control means for controlling said pressure setting means in order to change said compression force; and quantification means for quantifying, at a position closer to the distal end of a limb than said predetermined range of muscles, a quantification target that is associated with the state of blood flow that varies depending on said compression force.

The tight fitting device in this pressure muscle strength increasing apparatus has a gas bag. The compression force applied to muscles by it is varied by means of supplying a gas into the gas bag or removing the gas therefrom.

It should be noted that the quantification target in the present invention may be, as described above, any parameter that is quantified at a position closer to the distal end of the limb where the pressure muscle strength increasing method is carried out than the position on which the tight fitting device is rest. For example, the quantification target may be at least one of Korotkoff sounds, Swan sounds, and pulse waves.

They are all parameters representing the state of blood flow. They make it possible to determine the state of blood flow restriction when used as the quantification target.

These equally apply to the control device described below.

The quantification means of the present invention may be adapted to quantify said quantification target at a given time instant (regardless of whether it is performed continuously for a period of time or at a predetermined time interval). In addition, the control means in this case may be adapted to control said pressure setting means over time based on the quantification target at that time instant (regardless of whether it is performed continuously for a period of time or at a predetermined time interval).

Such a pressure muscle strength increasing apparatus can provide a longer period of time during which the blood flow is kept restricted in an appropriate manner. This provides a higher effect of implementation of the pressure muscle strength increasing method. At the same time, safety in implementing the pressure muscle strength increasing method becomes higher. In particular, when the quantification target is quantified for a continuous period of time and the pressure setting means is controlled in real time, a much higher effect of implementation of the pressure muscle strength increasing method can be obtained and, at the same time, safety in implementing the pressure muscle strength increasing method becomes much higher.

The control means of the present invention may have any specific configuration as long as it controls said pressure setting means based on the quantification target as described above.

When the pressure muscle strength increasing apparatus of the present invention comprises recording means on which ideal data that is the data relating to an ideal quantification target is recorded, then said control means may be adapted to compare the quantification target at a given time instant with an ideal quantification target that is represented by the ideal data read out of said recording means, and to control said pressure setting means so that the control is performed to make the quantification target at that time instant be closer to said ideal quantification target.

The ideal quantification target may be determined in association with time. In addition, the recording means may be provided inside or outside the control means.

The pressure muscle strength increasing apparatus may have a single tight fitting device or, alternatively, may have two or more tight fitting devices.

When pressure muscle strength increasing apparatus comprise of a plurality of tight fitting devices, the quantification means may be equal in number to said tight fitting devices, each being associated with each of said tight fitting devices to quantify said quantification target on the limb which its corresponding tight fitting device is wrapped around on the distal side thereof. In addition, said pressure setting means in this case may be equal in number to said tight fitting devices, each being associated with each of said tight fitting devices. The control means in this case may be adapted to individually control said pressure setting means associated with the tight fitting devices that are associated with said quantification means on which the quantification targets are determined, based on each of said quantification targets.

When pressure muscle strength increasing apparatus comprise of a plurality of tight fitting devices, a compression force may be applied to two or more sites on the limbs of a person who uses the pressure muscle strength increasing method. Alternatively, the pressure muscle strength increasing method may be applied to two or more people at the same time. The compression forces used in such a case may be different from individual tight fitting devices. The pressure muscle strength increasing apparatus as described above can individually control the compression forces applied to the limbs by using the tight fitting devices, so that it can be used in such a case.

The aforementioned control means may have a function to control said pressure setting means to remove the gas from said gas bag when said quantification target at that time instant falls into at least one of the following 1) to 3):

1) when the heart rate at that time instant is indicated to exceed a predetermined heart rate;

2) when the blood pressure at that time instant is indicated to become lower than a predetermined blood pressure; and 3) when pulsation at that time instant is indicated to be abnormal.

This can make the pressure muscle strength increasing method be safer.

With the pressure muscle strength increasing apparatus having such control means, safety in implementing the pressure muscle strength increasing method becomes higher.

The present invention also provides the following control device.

The control device of the present invention is used in combination with a tight fitting device which is intended to encircle a predetermined range of muscles of one of the limbs, is intended to apply a predetermined compression force to said predetermined range of muscles by means of compressing said predetermined range of muscles, and is designed so that said compression force can be varied; a pressure setting segment for use in controlling the compression force provided by said tight fitting device; and a quantification segment for quantifying, at a position closer to the distal end of a limb than said predetermined range of muscles, a quantification target that is associated with the state of blood flow that varies depending on said compression force.

This control device comprises receiving means that receives quantification target data, which is the data about the quantification target, from each of said quantification segments; control data generating means for generating control data for use in controlling said pressure setting segment to change said compression force based on the quantification target data that have been received; and sending means for sending said control data to said pressure setting segment.

This control device also provides the effects that the degree of blood flow restriction can be adjusted accurately even when the pressure muscle strength increasing method is used in a weightless state, that a person who uses the pressure muscle strength increasing method gets relief from troubles which otherwise occur in adjusting the compression force, and that the pressure muscle strength increasing method can be applied more easily to rehabilitation, as in the case of the aforementioned pressure muscle strength increasing apparatus, in contrast to conventional muscle strength increasing devices that involve knowledge and experiences.

The tight fitting device that is used in combination with the control device of the present invention may be the one including, as described above, a belt having the length that is enough to be wrapped around a predetermined range of muscles of one of the limbs, fastening means for fastening said belt with said belt being wrapped around said predetermined range of muscles, a gas bag provided in or on said belt, said gas bag being adapted to apply a predetermined compression force to said predetermined range of muscles by means of compressing said predetermined range of muscles when said gas bag is filled with gas while said belt that has been wrapped around said predetermined range of muscles is fastened by said fastening means.

Effects that are similar to those obtained in the aforementioned control device can be obtained in a control device that is used in combination with the tight fitting device of the type described; a pressure setting segment that is capable of forcing a gas into said gas bag and removing the gas from said gas bag; and a quantification segment for quantifying, at a position closer to the distal end of a limb than said predetermined range of muscles, a quantification target that is associated with the state of blood flow that varies depending on said compression force; in which the control segment comprises receiving means that receives quantification target data, which is the data about the quantification target, from each of said quantification segments; control data generating means for generating control data for use in controlling said pressure setting segment to change said compression force based on the quantification target data that have been received; and sending means for sending said control data to said pressure setting segment.

The quantification segment may be adapted to quantify said quantification target at a given time instant (regardless of whether it is performed continuously for a period of time or at a predetermined time interval).

In such a case, said receiving means may be adapted to receive said quantification target data over time (e.g., at a predetermined time interval or at a constant time interval, or continuously for a period of time). Said control data generating means may be adapted to generate said control data over time. Said sending means may be adapted to send said control data to said pressure setting segment over time.

Such a control device can provide a longer period of time during which the blood flow is kept restricted in an appropriate manner. This provides a higher effect of implementation of the pressure muscle strength increasing method. At the same time, safety in implementing the pressure muscle strength increasing method becomes higher. In particular, when such a control device is used that quantifies the quantification target for a continuous period of time and controls the pressure setting segment in real time, a much higher effect of implementation of the pressure muscle strength increasing method can be obtained and, at the same time, safety in implementing the pressure muscle strength increasing method becomes much higher.

The control data generating means may have any specific configuration as long as it is as described above.

The control device may comprise recording means on which ideal data that is the data relating to an ideal quantification target is recorded. If the control segment has such a configuration, said control data generating means may be adapted to compare the ideal data read out of said recording means with said quantification target data to generate said control data to control said pressure setting segment to make the quantification target data at that time instant be closer to said ideal data.

The aforementioned tight fitting device may be two or more. In such a case, said quantification segments may be equal in number to said tight fitting devices, each being associated with each of said tight fitting devices to quantify said quantification target on the limb which its corresponding tight fitting device is wrapped around on the distal side thereof, and said pressure setting segments may be equal in number to said tight fitting devices, each being associated with each of said tight fitting devices.

Said receiving means in the control segment in such a case is adapted to receive said quantification target data over time from each of said quantification segments, and said control data generating means may be adapted to individually control said pressure setting segments associated with the tight fitting devices that are associated with said quantification segments on which the quantification targets are determined, based on each of said quantification target data.

The control segment of the type described can be used conveniently because it can individually control the compression forces that are applied to the limbs of one or more persons by means of a plurality of tight fitting devices.

The control data generating means in the control segment may be adapted to generate control data for use in controlling said pressure setting segment to remove the gas from said gas bag when said quantification target at that time instant falls into, for example, at least one of the following 1) to 3):

1) when the heart rate at that time instant is indicated to exceed a predetermined heart rate;

2) when the blood pressure at that time instant is indicated to become lower than a predetermined blood pressure; and 3) when pulsation at that time instant is indicated to be abnormal.

With this control segment, safety in implementing the pressure muscle strength increasing method becomes higher.

In addition, the present invention provides the following method.

This method is carried out in a control device that is used in combination with a tight fitting device which is intended to encircle a predetermined range of muscles of one of the limbs, is intended to apply a predetermined compression force to said predetermined range of muscles by means of compressing said predetermined range of muscles, and is designed so that said compression force can be varied; a pressure setting segment for use in controlling the compression force provided by said tight fitting device; and a quantification segment for quantifying, at a position closer to the distal end of a limb than said predetermined range of muscles, a quantification target that is associated with the state of blood flow that varies depending on said compression force. The control segment carries out a step for receiving quantification target data, which is the data about the quantification target, from each of said quantification segments; a step for generating control data for use in controlling said pressure setting segment to change said compression force based on the quantification target data that have been received; and a step for sending said control data to said pressure setting segment.

This method also provides the effects that the degree of blood flow restriction can be adjusted accurately even when the pressure muscle strength increasing method is used in a weightless state, that a person who uses the pressure muscle strength increasing method gets relief from troubles which otherwise occur in adjusting the compression force, and that the pressure muscle strength increasing method can be applied more easily to rehabilitation, as in the case of the aforementioned pressure muscle strength increasing apparatus, in contrast to conventional muscle strength increasing devices that involve knowledge and experiences.

The tight fitting device used in this method may be the one as described above that includes a belt having the length that is enough to be wrapped around a predetermined range of muscles of one of the limbs; fastening means for fastening said belt with said belt being wrapped around said predetermined range of muscles; and a gas bag provided in or on said belt, said gas bag being adapted to apply a predetermined compression force to said predetermined range of muscles by means of compressing said predetermined range of muscles when said gas bag is filled with gas while said belt that has been wrapped around said predetermined range of muscles is fastened by said fastening means.

Effects that are similar to those obtained in the aforementioned method can be obtained in a method that is carried out in control device that is used in combination with the tight fitting device of the type described; a pressure setting segment that is capable of forcing a gas into said gas bag and removing the gas from said gas bag; and a quantification segment for quantifying, at a position closer to the distal end of a limb than said predetermined range of muscles, a quantification target that is associated with the state of blood flow that varies depending on said compression force, in which said control device carries out: a step for receiving quantification target data, which is the data about the quantification target, from each of said quantification segments; a step for generating control data for use in controlling said pressure setting segment to change said compression force based on the quantification target data that have been received; and a step for sending said control data to said pressure setting segment.

BEST MODES FOR CARRYING OUT THE INVENTION

Figure 1:
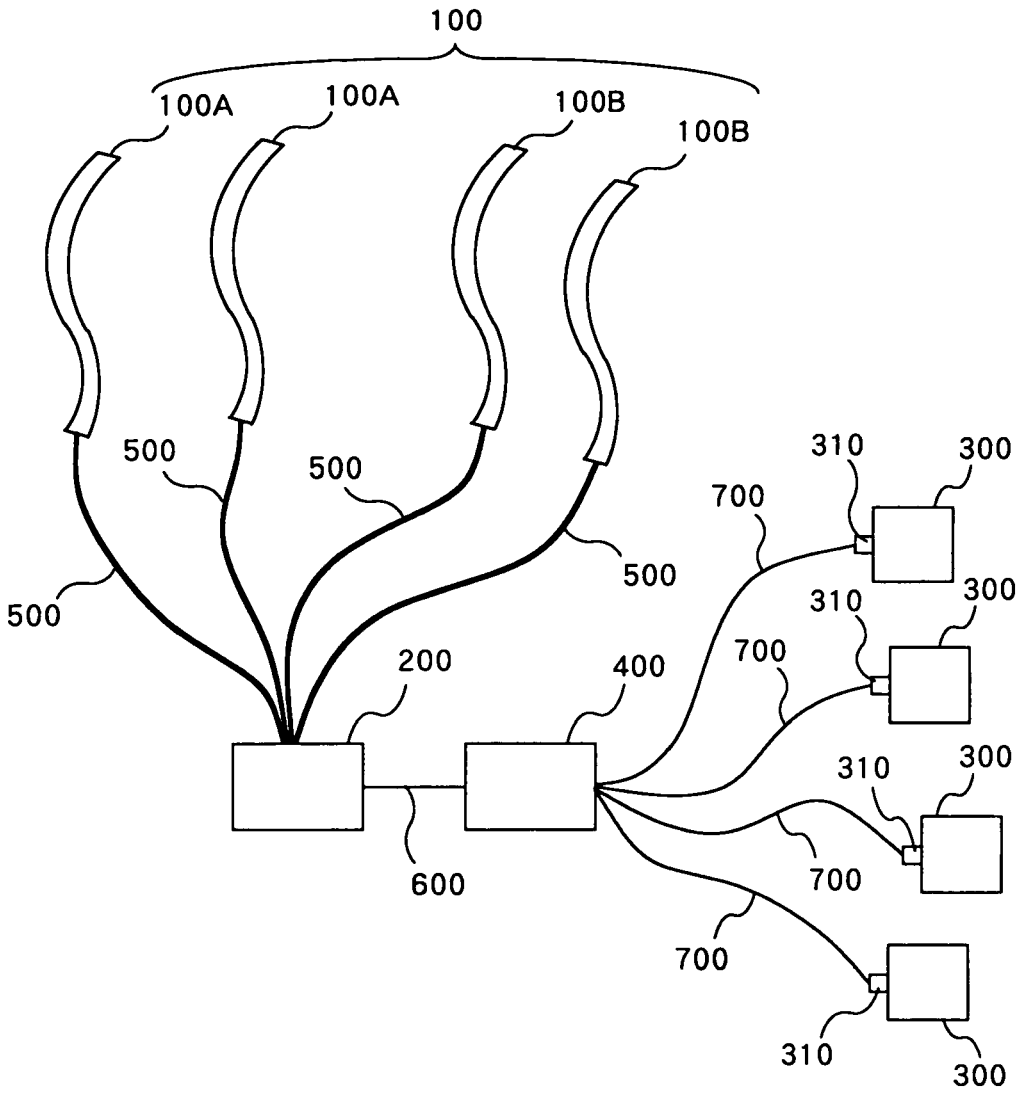
FIG. 1 is a view schematically showing the entire configuration of a pressure muscle strength increasing apparatus according to one embodiment of the present invention.

A preferred embodiment of the present invention is described now with reference to the drawing.

FIG. 1 is a view schematically showing the entire configuration of a pressure muscle strength increasing apparatus according to one embodiment of the present invention.

As shown in FIG. 1, the pressure muscle strength increasing apparatus of this embodiment is comprised of a tight fitting device 100, a pressure setting segment 200, quantification segments 300, and a control segment 400.

Figure 2:
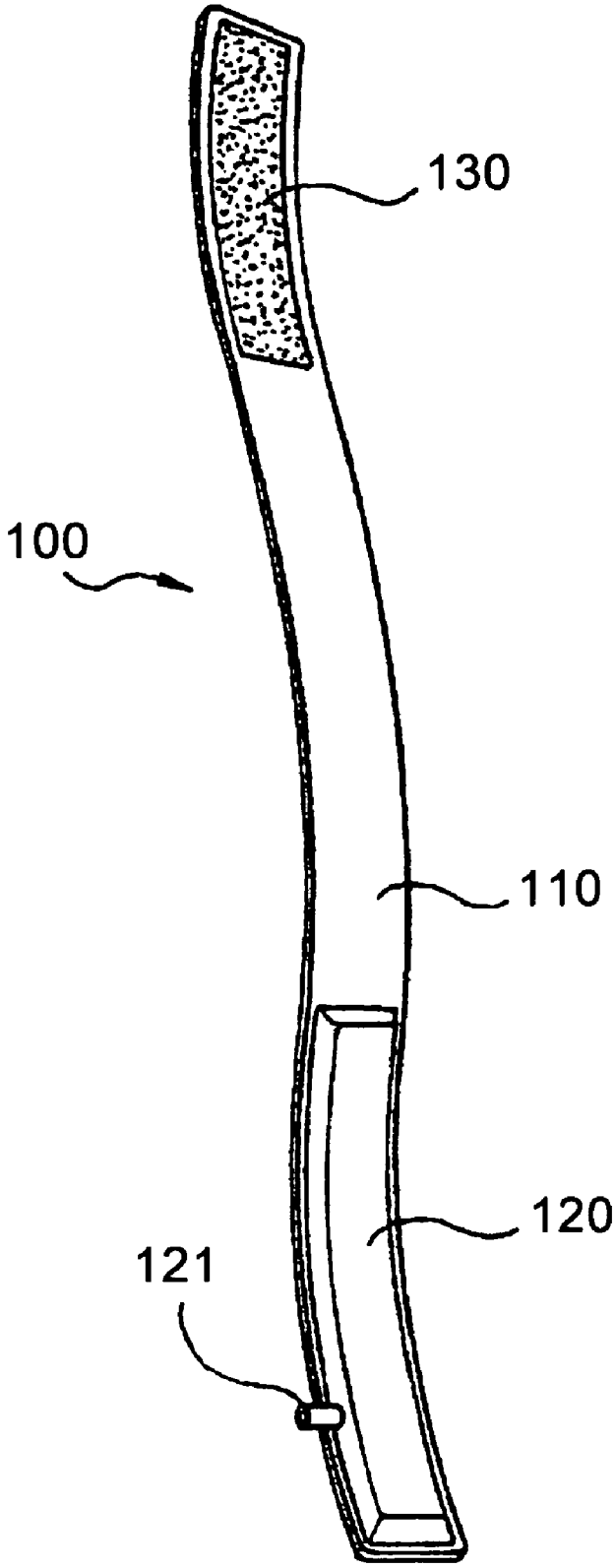
FIG. 2 is a perspective view showing a tight fitting device included in the pressure muscle strength increasing apparatus shown in FIG. 1.
Figure 3:
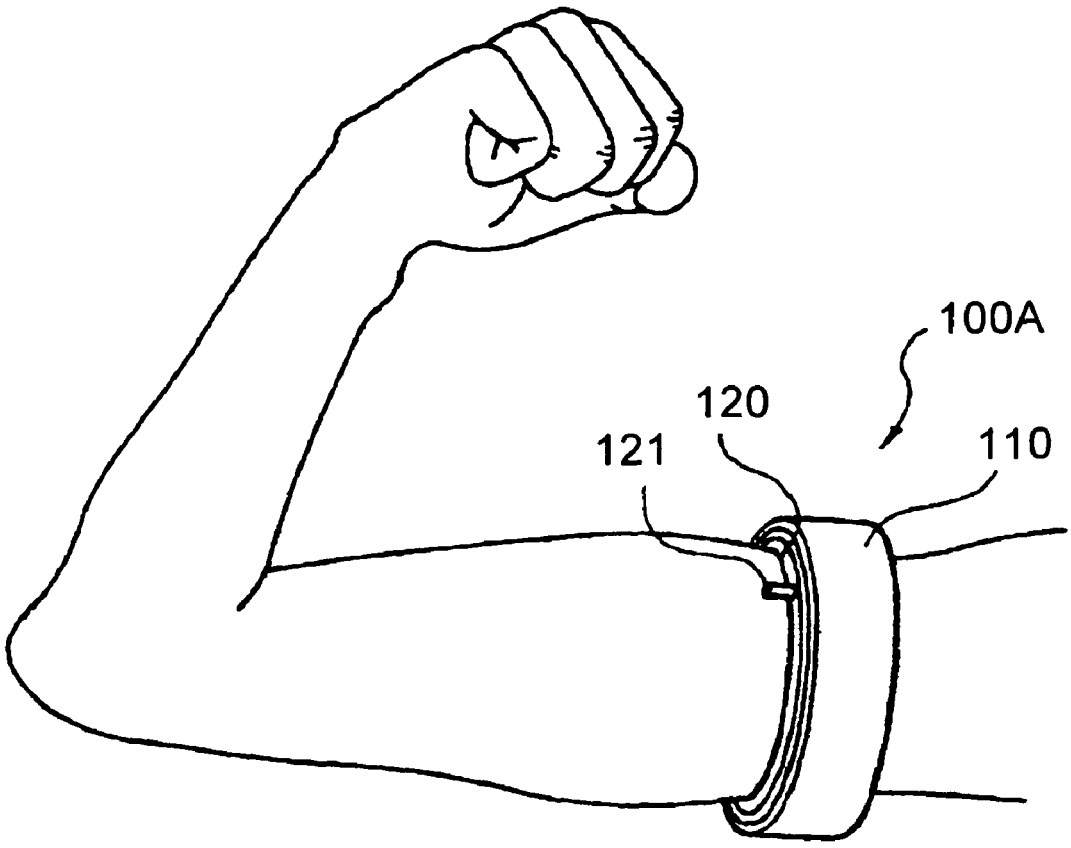
FIG. 3 is a view illustrating how a tight fitting device for arms included in the pressure muscle strength increasing apparatus shown in FIG. 1 is used.
Figure 4:
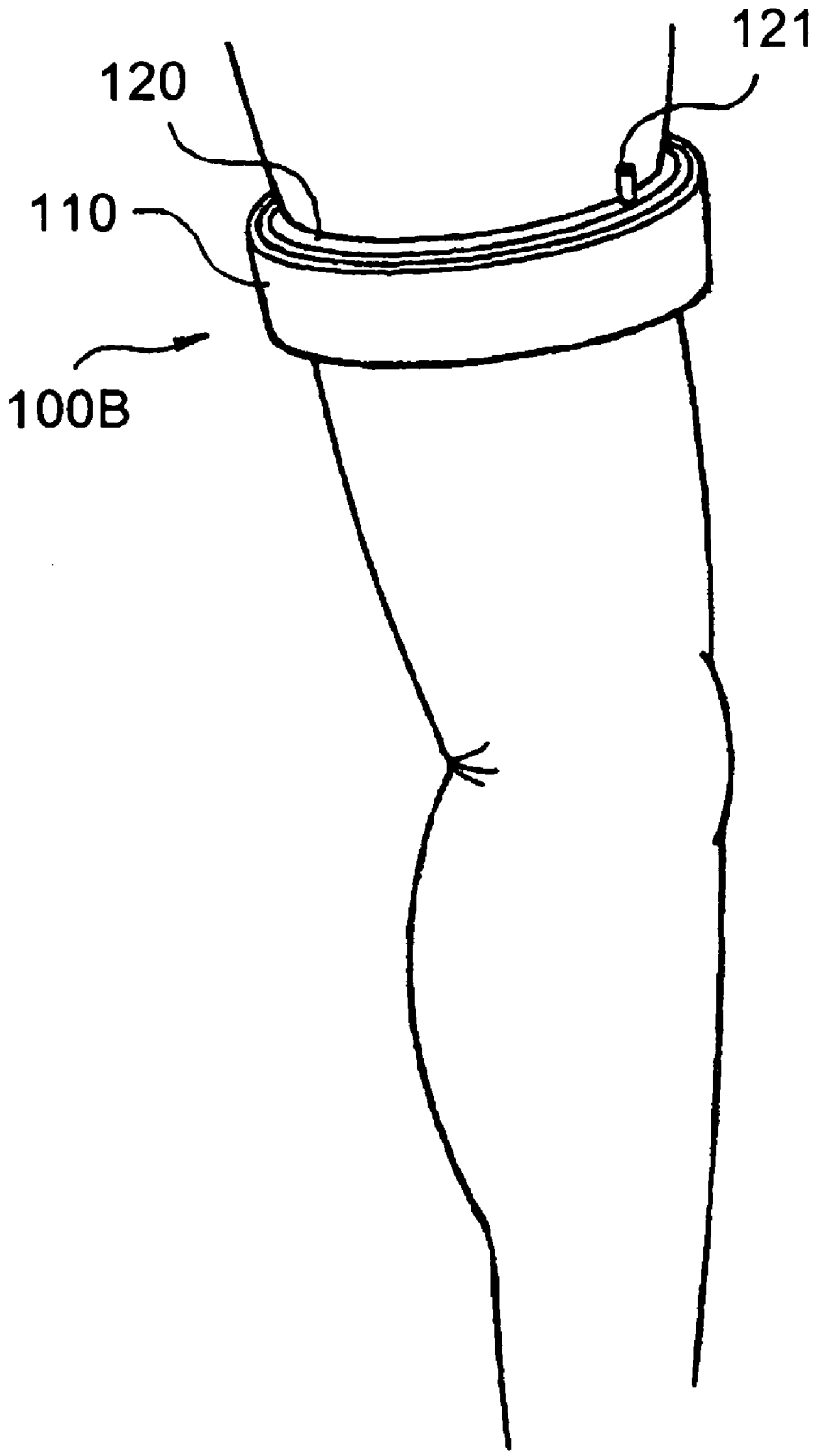
FIG. 4 is a view illustrating how a tight fitting device for legs included in the pressure muscle strength increasing apparatus shown in FIG. 1 is used.

The tight fitting device 100 in this embodiment is configured as shown in FIGS. 2, 3, and 4. FIG. 2 is a perspective view showing an embodiment of the tight fitting device 100. FIGS. 3 and 4 are perspective views illustrating how the tight fitting device 100 is used.

The tight fitting device 100 in this embodiment comprises a plurality of, more specifically, four members as shown in FIG. 1. The reason why there are four tight fitting devices 100 is to allow compression of both arms and both legs of a person who uses a pressure muscle strength increasing method. Of the tight fitting devices 100 in this embodiment, tightfitting devices 100A are for arms (that are intended to be wrapped around an arm for the compression of the arm) while tight fitting devices 100B are for legs (that are intended to be wrapped around a leg for the compression of the leg). The number of the tight fitting devices 100 is not necessarily four. Any number equal to or larger than one may be used. The number of the tight fitting device(s) 100A for arms is not necessarily identical with the number of the tight fitting device(s) 100B for legs.

The tight fitting device 100 in this embodiment is intended to encircle a predetermined range of muscles of one of the limbs, is intended to apply a predetermined compression force to said predetermined range of muscles by means of compressing said predetermined range of muscles, and is designed so that said compression force can be varied. This tight fitting device 100 basically comprises a belt 110, a gas bag 120, and a fastening member 130 in this embodiment.

Any belt may be used as the belt 110 as long as it can be wrapped around a predetermined range (the predetermined range is generally located at a position near the top of the arm or near the top of the leg that is suitable for the restriction of the blood flow by the external compression; which is hereinafter referred to as a "range to be compressed") which the tight fitting device 100 is wrapped around.

The belt 110 in this embodiment may be made of a stretchable material but is not necessarily so. More specifically, it is formed of a neoprene rubber.

The length of the belt 110 according to this embodiment is determined in accordance with the circumferential length of the range to be compressed by the tight fitting device 100 of a person who uses the pressure muscle strength increasing method. The length of the belt 110 may be any length that is longer than the circumferential length of the range to be compressed. The length of the belt 110 in this embodiment is twice or longer than the circumferential length of the range to be compressed. The length of the belt 110 of the tight fitting device 100A for arms according to this embodiment is determined in view of the circumferential length of the range to be compressed on the arm being 26 cm. More specifically it is 90 cm. The length of the belt 110 of the tight fitting device 100B for legs is determined in view of the circumferential length of the range to be compressed on the leg being 45 cm. More specifically, it is 145 cm.

The width of the belt 110 according to this embodiment may suitably be determined for the respective ranges to be compressed by the tight fitting device 100. For example, the belt 110 of the tight fitting device 100A for arms may be about 3 cm in width while the belt 110 of the tight fitting device 100B for legs may be about 5 cm in width.

The gas bag 120 is attached to the belt 110. The gas bag 120 in this embodiment is attached to one surface of the belt 110. However, the way to attach the gas bag 120 to the belt 110 is not limited thereto. The gas bag 120 may be provided within a bag-shaped belt 110.

One end of the gas bag 120 is aligned with the corresponding end of the belt 110 (the lower end of the belt 110 in FIG. 2) but is not necessarily so. The gas bag 120 is an air-tight bag that is formed of an air-tight material. The gas bag 120 in this embodiment is made of a stretchable rubber similar to that of, for example, an inflatable bladder used in a blood pressure cuff (a sleeve of a blood pressure gauge that is wrapped around the arm). The material of the gas bag 120 is not limited thereto. Any material that can maintain air tightness may appropriately be used.

The length of the gas bag 120 is, in this embodiment, generally equal to the circumferential length of the range to be compressed but is not necessarily so. In this embodiment, the gas bag 120 of the tight fitting device 100A for arms is 25 cm in length while the gas bag 120 of the tight fitting device 100B for legs is 45 cm in length.

The width of the gas bag 120 may suitably be determined for the respective ranges to be compressed by the tight fitting device 100. In this embodiment, the gas bag 120 of the tight fitting device 100A for arms is about 3 cm in width while the gas bag 120 of the tight fitting device 100B for legs is about 5 cm in width but is not necessarily so.

The gas bag 120 has a connection inlet 121 that is communicated with the inside of the gas bag 120. It may be connected with a pressure setting segment 200 through, for example, a connecting pipe 500 comprised of a rubber tube. As will be described below, through the connection inlet 121, a gas (air in this embodiment) is introduced into the gas bag 120 or the gas in the gas bag 120 escapes to the outside.

The fastening member 130 is for fastening the belt 110 so that it is held with being wrapped around the range to be compressed. The fastening member 130 in this embodiment is a two-dimensional fastener provided at the other end of the belt 110 (the upper end of the belt 110 in FIG. 2) on the side of the belt 110 where the gas bag 120 is provided. The fastening member 130 can be fastened to any part on the entire surface of the belt 110 where the gas bag 120 is not provided.

When the gas bag 120 is filled with air after the belt 110 is wrapped around the range to be compressed and the belt 110 is fastened by using the fastening member 130, the tight fitting device 100 compresses the muscles to apply the compression pressure. On the other hand, when the air is removed from the gas bag 120 at that state, the compression pressure applied by the tight fitting device 100 to the muscles becomes low.

The only requirement for the pressure setting segment 200 is that it can supply a gas to the gas bag 120 and remove the gas from the gas bag 120. The pressure setting segment 200 may have any one of possible configurations as long as it can supply a gas to the gas bag 120 and remove the gas from the gas bag 120.

Figure 5:
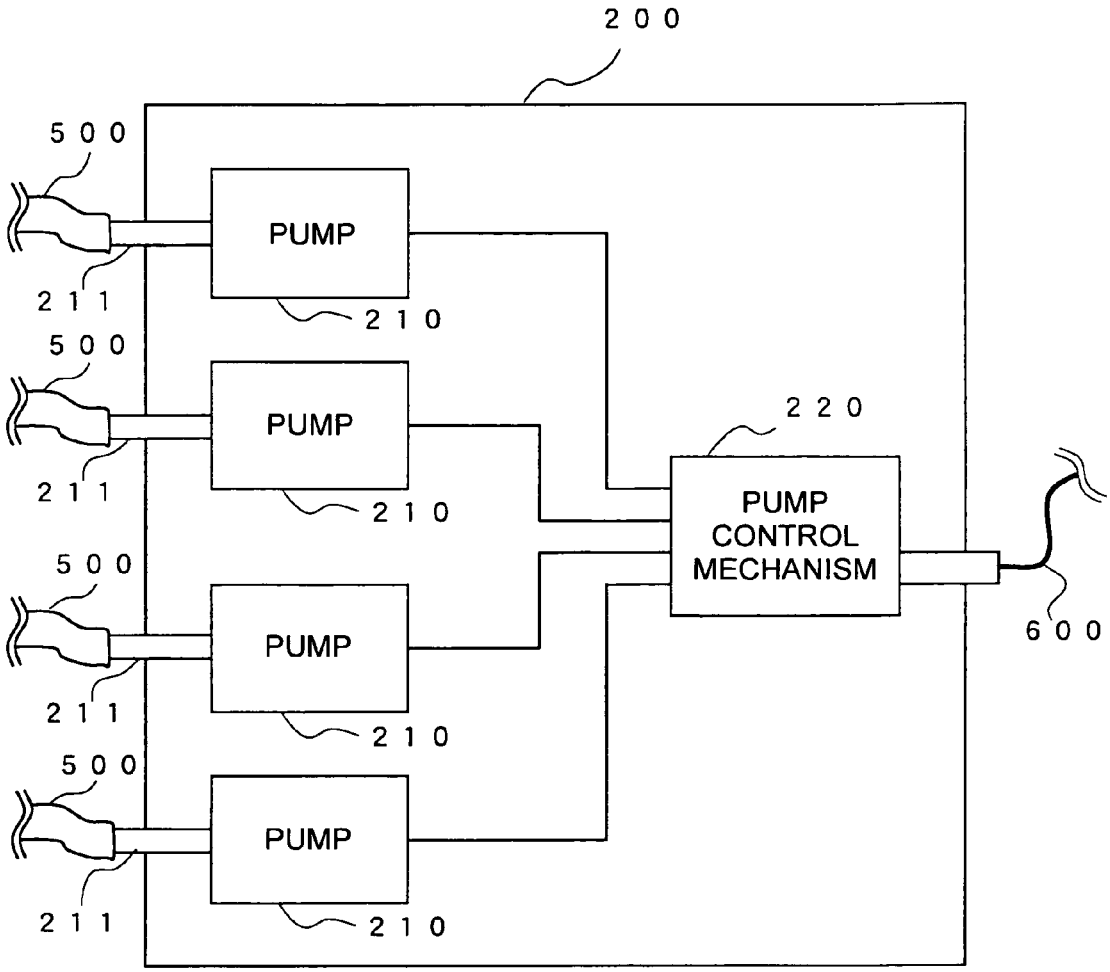
FIG. 5 is a view schematically showing an internal structure of the pressure setting segment included in the pressure muscle strength increasing apparatus shown in FIG. 1.

FIG. 5 schematically shows a configuration of an exemplified pressure setting segment 200. As shown in FIG. 5, the pressure setting segment 200 is composed of four pumps 210 and a pump control mechanism 220. These four pumps 210 are associated with four tight fitting devices 100, respectively.

The pump 210 has a function of sucking the surrounding gas (air in this embodiment) and supplying it to the outside of a pump connection inlet 211 which will be described below. It includes a valve which is not shown. Opening the valve results in removal of the gas in the pump 210 to the outside. Each of the four pumps 210 has its own pump connection inlet 211 and is connected to the gas bag 120 through the connecting pipe 500 connected thereto and the connection inlet 121 itself. When the pump 210 forces the gas, the gas is introduced into the gas bag 120. When the pump 210 opens the valve, the gas can be removed from the gas bag 120.

The quantification segment 300 is adapted to quantify, at a position closer to the distal end of the limb, the quantification target that is associated with the state of blood flow through the limb when the tight fitting device 100 is rest on a predetermined range to be compressed of the limb, in which the quantification target varies depending on the compression force applied by the tight fitting device to the predetermined range on the limb.

The quantification segment 300 in this embodiment comprises four members, as in the case of the tight fitting device 100. The four quantification segments 300 are associated with one of the tight fitting devices 100. This means that the pressure muscle strength increasing apparatus of this embodiment includes four pairs of the tight fitting device 100 and the quantification segment 300.

The quantification segment 300 in this embodiment can quantify at least one of Korotkoff sounds, Swan sounds, and pulse waves. Korotkoff sounds and Swan sounds are both sounds produced by vibrations of the vessel wall (sounds of blood flowing through the vessel). A device that can be used to detect these sounds may be, for example, a microphone. Korotkoff and Swan sounds can be detected by means of attaching a microphone to a proper region (e.g., the inner arm) for the detection of the sounds produced by vibrations of the vessel wall. On the other hand, pulse waves are the waveforms over the body surface representing volumetric changes in the blood vessels as blood pulses through certain regions of body tissues. A sphygmograph is a device known to be used for detecting pulse waves. For the pulse wave quantifing, it may be used as the quantification segment 300.

The quantification segment 300 in this embodiment can quantify the quantification target over time, but is not necessarily so. In other words, the quantification segment 300 can quantify a possibly ever-changing quantification target. The quantification segment 300 may continuously quantify the quantification target for a period of time. Alternatively, it may quantify the quantification target at a predetermined time interval or at a constant time interval. The quantification segment 300 in this embodiment quantifies the quantification target every 30 seconds.

All of the four quantification segments 300 quantify the aforementioned quantification target. They generate quantification target data representing the quantification target and send it to the control segment 400. In order to make this possible, the quantification segment 300 has an output terminal 310 (see FIG. 1) to send the quantification target data to the control segment 400 through the output terminal 310. In this embodiment, the output terminal 310 sends the quantification target data to the control segment 400 through a cable 700 connected at one end to the output terminal 310 and at the other end to the control segment 400. The configuration to send the quantification target data is not limited thereto. For example, data may be sent wirelessly by using a light beam. In this embodiment, the quantification target is obtained every 30 seconds as described above. The quantification target data is generated almost at the same time as the quantification target is obtained. The generated quantification target data is supplied to the control segment 400 at a 30-second interval almost at the same time as the generation of the quantification target data.

The control segment 400 is for use in controlling the pressure setting segment 200 according to the quantification target data received from the quantification segment 300.

Figure 6:
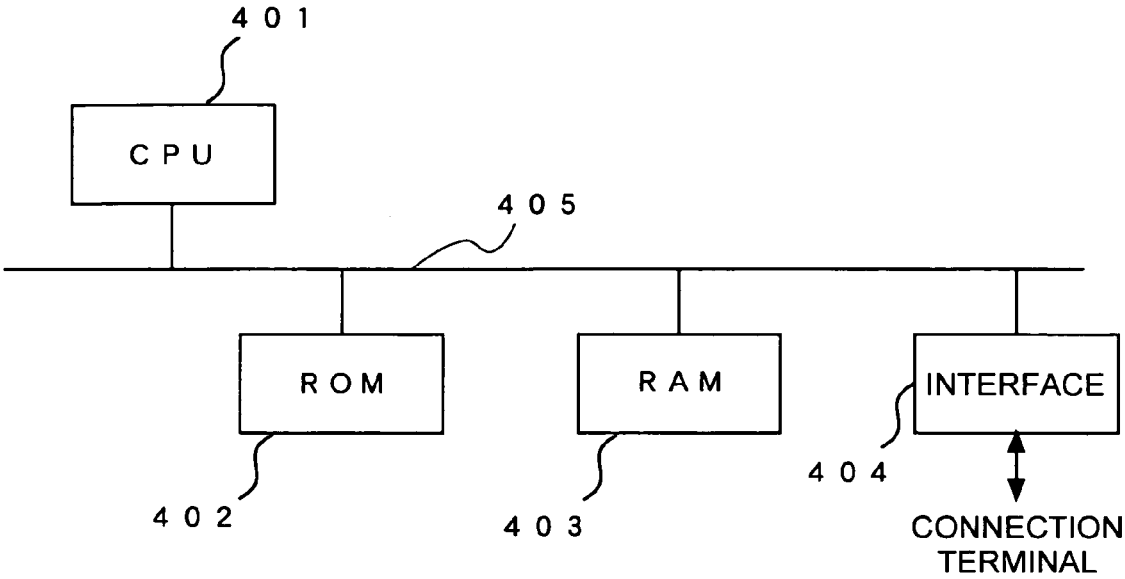
FIG. 6 is a hardware configuration of the control segment included in the pressure muscle strength increasing apparatus shown in FIG. 1.

The internal configuration of the control segment 400 is schematically shown in FIG. 6. The control segment 400 contains a computer. A CPU 401, an ROM 402, an RAM 403 and an interface 404 are connected to each other through a bus 405.

The CPU 401 is a central processing unit that controls the whole control segment 400. The ROM 402 records a program and data that are necessary for the processing described below in which the processing is carried out by the control segment 400. The CPU 401 executes the processing based on the program. The ROM 402 may be embodied by using a flash ROM or a hard disk. The RAM 403 is for providing a working area for the execution of the aforementioned program. The interface 404 is a device for the exchange of data between the outside. The interface 404 is connected to four connection terminals (not shown) that can be connected to one end of the cable 600 the other end of which is connected to the pressure setting segment 200, and four connection terminals (not shown) that can be connected to the other end of the cable 700. The aforementioned quantification target data supplied from the quantification segment 300 is received by the interface 404 through the cable 700. In addition, the control data described below is sent from the interface 404 to the pressure setting segment 200 through the cable 600.

Figure 7:
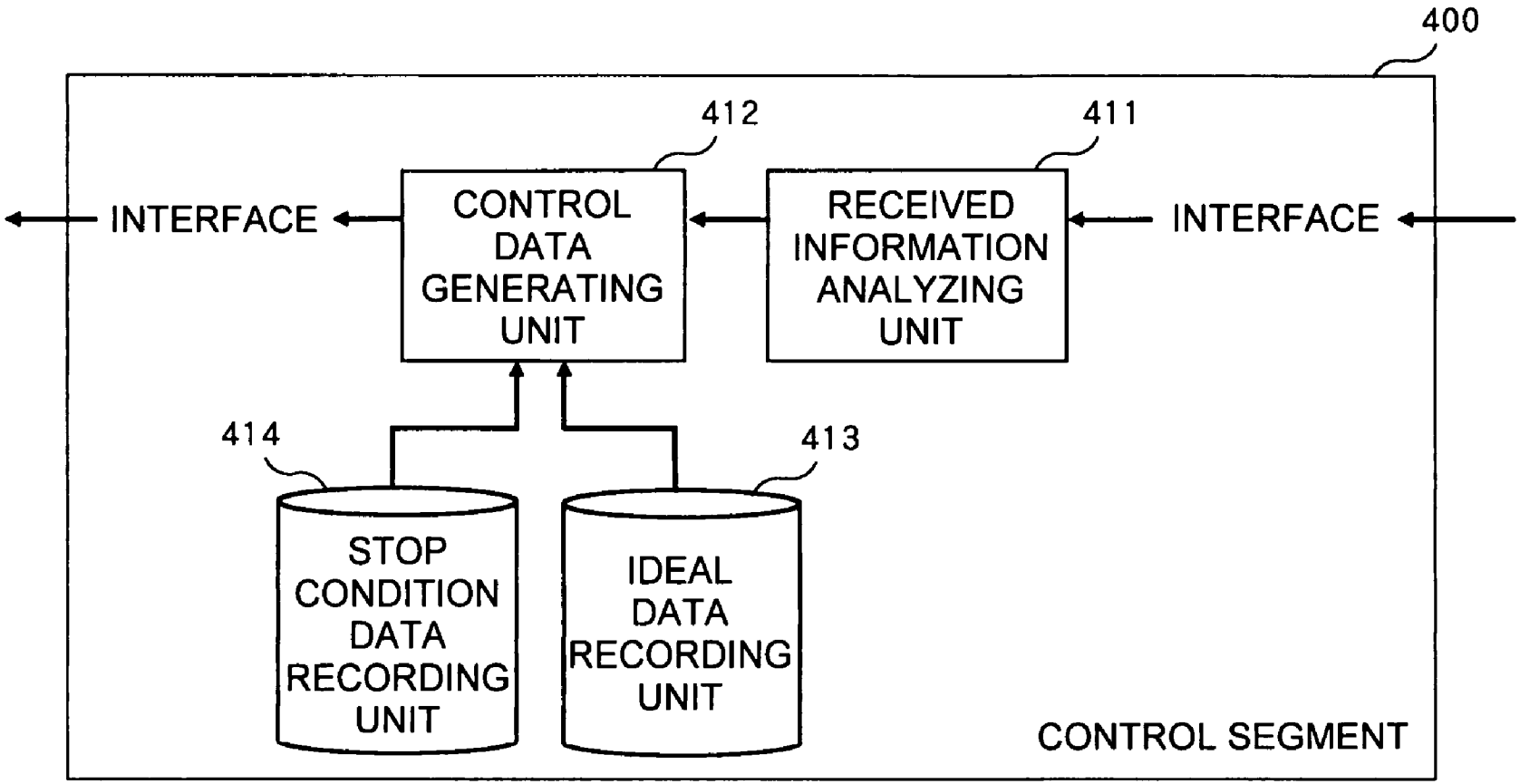
FIG. 7 is a view showing a functional block generated within the control segment included in the pressure muscle strength increasing apparatus shown in FIG. 1.

As the CPU 401 executes the aforementioned program, the functional block as shown in FIG. 7 is created within the control segment 400.

The control segment 400 includes a received information analyzing unit 411, a control data generating unit 412, an ideal data recording unit 413, and a stop condition data recording unit 414.

The received information analyzing unit 411 receives the quantification target data from the interface 404 and analyzes the details thereof. Data representing the result of analysis by the received information analyzing unit 411 is supplied to the control data generating unit 412.

The control data generating unit 412 is for generating the control data, which is used for controlling the pressure setting segment 200, according to the data received from the received information analyzing unit 411. The control data generating unit 412 supplies the generated control data to the interface 404. In generating the control data, the control data generating unit 412 uses ideal data recorded on the ideal data recording unit 413 and stop condition data recorded on the stop condition data recording unit 414.

The ideal data is the data relating to the ideal quantification target. The ideal data in this embodiment is the data, but not limited to, that represents the association between the elapsed time from the beginning and the quantification target that is considered to be ideal at that time, when carrying out the pressure muscle strength increasing method. In other words, recorded on the ideal data recording unit 413 as the ideal data is the data about the information indicating how strong the compression force would be after how much time has elapsed from the beginning and what the quantification target at that time would be.

On the other hand, the stop condition data is the data indicating conditions for stopping the pressure muscle strength increasing method that is being executed. This embodiment uses the following three conditions as the conditions for stopping the pressure muscle strength increasing method: 1) when the heart rate at that time instant represented by the quantification target is indicated to exceed a predetermined heart rate, 2) when the blood pressure at that time instant represented by the quantification target is indicated to become lower than a predetermined blood pressure, and 3) when pulsation at that time instant represented by the quantification target is indicated to be abnormal.

The processing carried out by the control data generating unit 412 is described.

As mentioned above, the control segment 400 receives the quantification target data every 30 seconds for example from the quantification segment 300. The quantification target data is supplied to the received information analyzing unit 411 through the interface 404. The information generated therein is supplied to the control data generating unit 412.

In response to this, the control data generating unit 412 determines how many seconds have elapsed from the beginning of the execution of the pressure muscle strength increasing method when the quantification target data received at that time instant is issued. It then compares the quantification target data with the ideal data read out of the ideal data recording unit 413 to determine whether or not the quantification target data is proper as the data that should be received at that time. In order to make this possible, the control data generating unit 412 has a timer which is not shown for counting the time interval from the beginning of the execution of the pressure muscle strength increasing method.

For example, when the received quantification target data represents the match with the quantification target that is represented by the ideal data that should be received at that time, or when an offset from the quantification target of the ideal data is within a predetermined range of values, the control data generating unit 412 in this embodiment generates control data for controlling the pump control mechanism 220 to prevent it from driving the pump 210. When the received quantification target data is shifted up from the quantification target that is represented by the ideal data that should be received at that time, and when the amount of this offset exceeds a predetermined range of values, the control data generating unit 412 in this embodiment generates the control data for use in causing the pump control mechanism 220 to drive the pump 210 to change the pressure within the gas bag 120 so that the quantification target that is obtained by the quantification segment 300 lowers. On the other hand, when the received quantification target data is shifted down from the quantification target that is represented by the ideal data that should be received at that time, and when the amount of this offset exceeds a predetermined range of values, the control data generating unit 412 in this embodiment generates the control data for use in causing the pump control mechanism 220 to drive the pump 210 to change the pressure within the gas bag 120 so that the quantification target that is obtained by the quantification segment 300 rises. In other words, when the compression force is insufficient, the control data is generated so that the pump control mechanism 220 controls the pump 210 to supply air to the gas bag 120. When the compression force is excessive, the control data is generated so that the pump control mechanism 220 controls the pump 210 to open the valve and remove the air from the gas bag 120. The pressure within the gas bag 120 is kept within a certain range in which the quantification target that is obtained by the quantification segment 300 matches the quantification target that is represented by the ideal data as a result of the control data generating unit 412 generating the control data in the manner as described above.

The generation of the aforementioned control data achieved by the control data generating unit 412 is performed individually for each pair of the quantification segment 300 and the pressure setting segment 200. This means that the generation of the aforementioned control data in this embodiment is performed four times for the pairs of the quantification segment 300 and the pressure setting segment 200. The pump control mechanism 220 determines which pump 210 the received control data associates with and then controls the appropriate pump 210 based on the result of it. In order to make this possible, the control data in this embodiment contains data indicating which one of the pumps 210 (or the tight fitting devices 100) the control data in question associates with.

In order to achieve the individual generation of the control data four times as described above, the ideal data recording unit 413 records four sets of ideal data corresponding to the pairs of the quantification segment 300 and the pressure setting segment 200. These sets of ideal data may be identical to each other or, alternatively, may be different from each other. The sets of ideal data may be updated externally. These sets of ideal data are not required to be recorded on the recording medium in the control segment 400. For example, they may be recorded on an external recording medium such as a CD-ROM and read to the control segment 400 when necessary.

In addition, the control data generating unit 412 determines whether or not the quantification target at that time instant represented by the received quantification target data corresponds to the aforementioned condition(s) to stop the pressure muscle strength increasing method. Either one of the following conditions holds good, the control data generating unit 412 in this embodiment generates the control data to cause the pump control mechanism 220 to control the pump 210 so that the pump 210 is driven to open the valve and remove the air from the gas bag 120: 1) when the heart rate at that time instant represented by the quantification target is indicated to exceed a predetermined heart rate, 2) when the blood pressure at that time instant represented by the quantification target is indicated to become lower than a predetermined blood pressure, and 3) when pulsation at that time instant represented by the quantification target is indicated to be abnormal. The conditions 1) to 3) may be held good only when the conditions 1) to 3) continue for a predetermined period of time or longer.

It should be noted that the control data generating unit 412 generates the control data as described above but, the control data generating unit 412 in this embodiment generates the control data to cause the pump control mechanism 220 to control the pump 210 so that the pump 210 is driven to open the valve and remove the air from the gas bag 120 when there is a condition to stop the pressure muscle strength increasing method, regardless of the relation between the quantification target that is represented by the quantification target at that time instant data and the ideal quantification target that is represented by the ideal data at that time instant.

The generation of the aforementioned control data is performed in almost real time every time when the quantification target data is supplied to the control data generating unit 412. The generated control data is supplied to the pressure setting segment 200 in almost real time. As a result, the pressure setting segment 200 and the gas bag 120 of the tight fitting device 100 are controlled in almost real time based on the quantification target that is obtained by the quantification segment 300.

Next, how the pressure muscle strength increasing apparatus is used is described briefly.

First, the four tight fitting devices 100 are wrapped around the ranges to be compressed on the limbs of a person who uses the pressure muscle strength increasing method. The two tight fitting devices 100A for arms are rest on the arms and the two tight fitting devices 100B for legs are rest on the legs. More specifically, the gas bag 120 is encircled once around the range to be compressed, and the excessive length of belt 110 is further encircled two times around it. With this state, the fastening member 130 is used to fasten the end of the belt 110.

Next, the four quantification segments 300 are attached to the arms and legs on which the four tight fitting devices 100 are rest, respectively, on the distal sides thereof. In this event, the quantification segments 300 corresponding to the respective four tight fitting devices 100 are attached to the arms and legs on which the corresponding tight fitting devices 100 are rest, respectively, on the distal sides thereof.

Next, the four tight fitting devices 100 are connected to the pressure setting segment 200 through the respective connecting pipes 500. The four quantification segments 300 are connected to the control segment 400 through the respective cables 700. The control segment 400 and the pressure setting segment 200 are connected to each other through the cable 600.

With this state, the pressure muscle strength increasing method begins. The change in pressure within the gas bag 120 results in variations in compression pressure applied to the range to be compressed on the limb by the tight fitting device 100. The quantification target that changes accordingly is obtained by each quantification segment 300 over time. The quantification target data representing the quantification target are supplied from each quantification segment 300 to the control segment 400. The control segment 400 generates the control data as described above, and then send it to the pressure setting segment 200. The pressure setting segment 200 drives the pumps 210 while being controlled by the control data supplied from the control segment 400 to supply and remove air into and from the gas bag 120 of each tight fitting device 100.

The aforementioned pressure adjustment is made automatically.

A person who uses the pressure muscle strength increasing method may either do exercises with this state or keep rest without any exercises. Although the former achieves muscle strength increase at a higher level, the latter can also increase the muscle strength.

The invention claimed is:

1. A pressure muscle strength increasing apparatus comprising:

a tight fitting device including a belt having the length that is enough to be wrapped around a predetermined range of muscles of one of the limbs; fastening means for fastening said belt with said belt being wrapped around said predetermined range of muscles; and a gas bag provided in or on said belt, said gas bag being adapted to apply a predetermined compression force to said predetermined range of muscles by means of compressing said predetermined range of muscles when said gas bag is filled with gas while said belt that has been wrapped around said predetermined range of muscles is fastened by said fastening means;

pressure setting means that is capable of forcing a gas into said gas bag and removing the gas from said gas bag;

control means for controlling said pressure setting means in order to change said compression force; and quantification means for quantifying, at a position closer to the distal end of a limb than said predetermined range of muscles, a quantification target that is associated with the state of blood flow that varies depending on said compression force;

said control means controlling said pressure setting means based on said quantification target, wherein said quantification means is adapted to quantify said quantification target at a given time instant, and said control means is adapted to control said pressure setting means over time based on the quantification target at that time instant, further comprising recording means on which ideal data that is the data relating to an ideal quantification target is recorded, wherein the ideal data represents an association between an elapsed time from the beginning of use of the pressure muscle strength increasing apparatus and the quantification target that is considered to be ideal at that time;

said control means being adapted to compare the quantification target at a given time instant with an ideal quantification target that is represented by the ideal data read out of said recording means, and to control said pressure setting means so that the control is performed to make the quantification target at that time instant be closer to said ideal quantification target by increasing or decreasing the pressure setting.

2. The pressure muscle strength increasing apparatus as claimed in claim 1, wherein said pressure muscle strength increasing apparatus comprising of a plurality of tight fitting devices, said quantification means are equal in number to said tight fitting devices, each being associated with each of said tight fitting devices to quantify said quantification target on the limb which its corresponding tight fitting device is wrapped around on the distal side thereof, said pressure setting means are equal in number to said tight fitting devices, each being associated with each of said tight fitting devices, said control means being adapted to individually control said pressure setting means associated with the tight fitting devices that are associated with said quantification means on which the quantification targets are determined, based on each of said quantification targets.

3. The pressure muscle strength increasing apparatus as claimed in claim 1, wherein said quantification target is at least one of Korotkoff sounds, Swan sounds, and pulse waves.

4. The pressure muscle strength increasing apparatus as claimed in claim 1, wherein said control means is adapted to control said pressure setting means to remove the gas from said gas bag when said quantification target at that time instant falls into at least one of the following 1) to 3):

1) when the heart rate at that time instant is indicated to exceed a predetermined heart rate;

2) when the blood pressure at that time instant is indicated to become lower than a predetermined blood pressure; and 3) when pulsation at that time instant is indicated to be abnormal.

5. The apparatus of claim 1, wherein said quantification target is one of Korotkoff sounds and Swan sounds.

6. A control device for a pressure muscle strength increasing apparatus that is used in combination with:

a tight fitting device including a belt having the length that is enough to be wrapped around a predetermined range of muscles of one of the limbs, fastening means for fastening said belt with said belt being wrapped around said predetermined range of muscles, a gas bag provided in or on said belt, said gas bag being adapted to apply a predetermined compression force to said predetermined range of muscles by means of compressing said predetermined range of muscles when said gas bag is filled with gas while said belt that has been wrapped around said predetermined range of muscles is fastened by said fastening means;

a pressure setting segment that is capable of forcing a gas into said gas bag and removing the gas from said gas bag; and a quantification segment for quantifying, at a position closer to the distal end of a limb than said predetermined range of muscles, a quantification target that is associated with the state of blood flow that varies depending on said compression force;

said control device comprising:

receiving means that receives quantification target data, which is the data about the quantification target, from each of said quantification segments;

control data generating means for generating control data and controlling said pressure setting segment to change said compression force based on the quantification target data that have been received; and sending means for sending said control data to said pressure setting segment, wherein said quantification segment is adapted to quantify said quantification target at a given time instant, and said control device is adapted to control said pressure setting means over time based on the quantification target at that time instant, further comprising recording means on which ideal data that is the data relating to an ideal quantification target is recorded, wherein the ideal data represents an association between an elapsed time from the beginning of use of the pressure muscle strength increasing apparatus and the quantification target that is considered to be ideal at that time;

said control device being adapted to compare the quantification target at a given time instant with an ideal quantification target that is represented by the ideal data read out of said recording means, and to control said pressure setting means so that the control is performed to make the quantification target at that time instant be closer to said ideal quantification target by increasing or decreasing the pressure setting.

7. The control device for a pressure muscle strength increasing apparatus as claimed in claim 6, wherein the control device is used in combination with a plurality of tight fitting devices, when said quantification segments are equal in number to said tight fitting devices, each being associated with each of said tight fitting devices to quantify said quantification target on the limb which its corresponding tight fitting device is wrapped around on the distal side thereof, when said pressure setting segments are equal in number to said tight fitting devices, each being associated with each of said tight fitting devices, said receiving means being adapted to receive said quantification target data over time from each of said quantification segments, said control data generating means being adapted to individually control said pressure setting segments associated with the tight fitting devices that are associated with said quantification segments on which the quantification targets are determined, based on each of said quantification target data.

8. The control device for a pressure muscle strength increasing apparatus as claimed in claim 6, wherein said quantification target is at least one of Korotkoff sounds, Swan sounds, and pulse waves.

9. The control device for a pressure muscle strength increasing apparatus as claimed in claim 6, wherein said control data generating means is adapted to generate control data for use in controlling said pressure setting segment to remove the gas from said gas bag when said quantification target at that time instant falls into at least one of the following 1) to 3):

1) when the heart rate at that time instant is indicated to exceed a predetermined heart rate;

2) when the blood pressure at that time instant is indicated to become lower than a predetermined blood pressure; and 3) when pulsation at that time instant is indicated to be abnormal.

10. The control device for a pressure muscle strength increasing apparatus of claim 6, wherein said quantification target is one of Korotkoff sounds and Swan sounds.

11. A pressure muscle strength increasing apparatus comprising:

a tight fitting device which is intended to encircle a predetermined range of muscles of one of the limbs, is intended to apply a predetermined compression force to said predetermined range of muscles by means of compressing said predetermined range of muscles, and is designed so that said compression force can be varied;

pressure setting means for use in controlling the compression force provided by said tight fitting device;

control means for controlling said pressure setting means in order to change said compression force; and quantification means for quantifying, at a position closer to the distal end of a limb than said predetermined range of muscles, a quantification target that is associated with the state of blood flow that varies depending on said compression force;

said control means controlling said pressure setting means based on said quantification target, wherein said quantification means is adapted to quantify said quantification target at a given time instant, and said control means is adapted to control said pressure setting means over time based on the quantification target at that time instant, further comprising recording means on which ideal data that is the data relating to an ideal quantification target is recorded, wherein the ideal data represents an association between an elapsed time from the beginning of use of the pressure muscle strength increasing apparatus and the quantification target that is considered to be ideal at that time;

said control means being adapted to compare the quantification target at a given time instant with an ideal quantification target that is represented by the ideal data read out of said recording means, and to control said pressure setting means so that the control is performed to make the quantification target at that time instant be closer to said ideal quantification target by increasing or decreasing the pressure setting.

12. The apparatus of claim 11, wherein said quantification target is one of Korotkoff sounds and Swan sounds.

13. A control device for a pressure muscle strength increasing apparatus that is used in combination with:

a tight fitting device which is intended to encircle a predetermined range of muscles of one of the limbs, is intended to apply a predetermined compression force to said predetermined range of muscles by means of compressing said predetermined range of muscles, and is designed so that said compression force can be varied;

a pressure setting segment for use in controlling the compression force provided by said tight fitting device; and a quantification segment for quantifying, at a position closer to the distal end of a limb than said predetermined range of muscles, a quantification target that is associated with the state of blood flow that varies depending on said compression force;

said control segment comprising:

receiving means that receives quantification target data, which is the data about the quantification target, from said quantification segment;

control data generating means for generating control data and controlling said pressure setting segment to change said compression force based on the quantification target data that have been received; and sending means for sending said control data to said pressure setting segment, wherein said quantification segment is adapted to quantify said quantification target at a given time instant, and said control segment is adapted to control said pressure setting means over time based on the quantification target at that time instant, further comprising recording means on which ideal data that is the data relating to an ideal quantification target is recorded, wherein the ideal data represents an association between an elapsed time from the beginning of use of the pressure muscle strength increasing apparatus and the quantification target that is considered to be ideal at that time;

said control segment being adapted to compare the quantification target at a given time instant with an ideal quantification target that is represented by the ideal data read out of said recording means, and to control said pressure setting means so that the control is performed to make the quantification target at that time instant be closer to said ideal quantification target by increasing or decreasing the pressure setting.

14. The control device for a pressure muscle strength increasing apparatus of claim 13, wherein said quantification target is one of Korotkoff sounds and Swan sounds.

15. A method that is carried out in a control device for a pressure muscle strength increasing apparatus that is used in combination with:

a tight fitting device which is intended to encircle a predetermined range of muscles of one of the limbs, is intended to apply a predetermined compression force to said predetermined range of muscles by means of compressing said predetermined range of muscles, and is designed so that said compression force can be varied;

a pressure setting segment for use in controlling the compression force provided by said tight fitting device; and a quantification segment for quantifying, at a position closer to the distal end of a limb than said predetermined range of muscles, a quantification target that is associated with the state of blood flow that varies depending on said compression force;

said method comprising:

a step for receiving quantification target data, which is the data about the quantification target, from said quantification segment;

a step for generating control data for use in controlling said pressure setting segment to change said compression force based on the quantification target data that have been received; and a step for sending said control data to said pressure setting segment, a step for quantifying said quantification target at a given time instant, and a step for controlling said pressure setting means over time based on the quantification target at that time instant, a step for recording the data relating to an ideal quantification target;

a step for comparing the quantification target at a given time instant with an ideal quantification target that is represented by the ideal data read out of said recording means, wherein the ideal data represents an association between an elapsed time from the beginning of use of the pressure muscle strength increasing apparatus and the quantification target that is considered to be ideal at that time;

and a step for controlling said pressure setting means so that the control is performed to make the quantification target at that time instant be closer to said ideal quantification target by increasing or decreasing the pressure setting.

16. A method that is carried out in a control device for a pressure muscle strength increasing apparatus that is used in combination with:

a tight fitting device including a belt having the length that is enough to be wrapped around a predetermined range of muscles of one of the limbs, fastening means for fastening said belt with said belt being wrapped around said predetermined range of muscles, a gas bag provided in or on said belt, said gas bag being adapted to apply a predetermined compression force to said predetermined range of muscles by means of compressing said predetermined range of muscles when said gas bag is filled with gas while said belt that has been wrapped around said predetermined range of muscles is fastened by said fastening means;

a pressure setting segment that is capable of forcing a gas into said gas bag and removing the gas from said gas bag; and a quantification segment for quantifying, at a position closer to the distal end of a limb than said predetermined range of muscles, a quantification target that is associated with the state of blood flow that varies depending on said compression force;

said method comprising:

a step for receiving quantification target data, which is the data about the quantification target, from said quantification segment;

a step for generating control data for use in controlling said pressure setting segment to change said compression force based on the quantification target data that have been received; and a step for sending said control data to said pressure setting segment, a step for controlling said pressure setting means over time based on the quantification target at that time instant, a step for recording data relating to an ideal quantification target;

a step for comparing the quantification target at a given time instant with an ideal quantification target that is represented by the recorded data relating to an ideal quantification target, wherein the ideal quantification target represents an association between an elapsed time from the beginning of use of the pressure muscle strength increasing apparatus and the quantification target that is considered to be ideal at that time; and a step for controlling said pressure setting means to make the quantification target at that time instant be closer to said ideal quantification target by increasing or decreasing the pressure setting, wherein said quantification segment is adapted to quantify said quantification target at a given time instant.

* * * * *